US005503396A

United States Patent [19]

Veylupek, Jr. et al.

[11] Patent Number: 5,503,396

[45] Date of Patent: Apr. 2, 1996

[54] COMBINATION BUSINESS CARD AND GOLF TEE

[76] Inventors: Robert J. Veylupek, Jr., 2601 Grand Canyon, #2068, Las Vegas, Nev. 89117; George I. Wallace, II, 7545 Maycrest Cir., Las Vegas, Nev. 89128

[21] Appl. No.: 210,125

[22] Filed: Mar. 17, 1994

[51] Int. Cl.[6] ..... A63B 57/00

[52] U.S. Cl. ..... 273/210; 273/205; 273/202

[58] Field of Search ..... 273/33, 202, 203, 273/205, 206, 207, 208, 209, 210

[56] References Cited

U.S. PATENT DOCUMENTS

| | | | |
|---|---|---|---|
| 207,171 | 3/1967 | Gardiner . | |
| 1,103,091 | 7/1914 | Smith | 273/210 |
| 1,583,830 | 5/1926 | Hicks | 273/211 |
| 1,593,458 | 7/1926 | McBride . | |
| 1,611,332 | 12/1926 | Bunnell | 273/210 |
| 1,635,376 | 7/1927 | McIlvaine | 273/210 |
| 1,644,804 | 10/1927 | Whitcomb . | |
| 1,661,513 | 3/1928 | Swett . | |
| 1,674,814 | 6/1928 | Anderson . | |
| 1,675,335 | 7/1928 | Drevitson | 273/202 |
| 1,766,938 | 6/1930 | Phillips . | |
| 1,897,519 | 2/1933 | Kershaw . | |
| 2,072,688 | 3/1937 | Rose . | |
| 2,103,026 | 12/1937 | Van Valkenburg . | |
| 2,809,839 | 10/1957 | Overbaugh . | |
| 2,898,110 | 8/1959 | Overbaugh . | |
| 2,930,615 | 3/1960 | Cowan . | |
| 3,063,722 | 11/1962 | Overbaugh . | |
| 3,697,082 | 10/1972 | Di Laura et al. . | |
| 4,162,071 | 7/1979 | Fish et al. . | |
| 4,887,817 | 12/1989 | Pelc . | |

*Primary Examiner*—Raleigh W. Chiu
*Assistant Examiner*—Steven B. Wong
*Attorney, Agent, or Firm*—Quirk & Tratos

[57] ABSTRACT

A golf tee device is disclosed. In one form, the device comprises a flat business-sized card having first and second edges and side portions there between, the card having advertising or other printing thereon. The card includes interengaging means for connecting the side portions of the card in the form of a partially separable tab, which tab comprises a stem, body, and neck having a number of keys thereon. A slot having a wide opening and an engaging portion is located in the card adjacent the end of the tab. The device is transformed to a golf tee by passing one or more of the keys of the tab through the wide opening in the slot and locking the tab into the engaging portion of the slot. The tee comprises the card in arched form, with the ends of the card acting as legs for the tee, and the absence of the body portion of the tab from the card forming a saddle elevated above the ground into which a golf ball may be placed.

22 Claims, 2 Drawing Sheets

COMBINATION BUSINESS CARD AND GOLF TEE

FIELD OF THE INVENTION

The present invention relates to a golf ball tee. More specifically, the present invention relates to a device which is easily transformable from a business card into a golf ball tee and vice versa.

BACKGROUND OF THE INVENTION

Golf tees are typically used to raise a golf ball above the playing surface in order that the golfer may more easily strike the golf ball. Conventional golf tees typically comprise a slender wooden or plastic shaft having one end which is tapered to facilitate insertion into the ground, and a second end comprising a small concave cup for supporting a golf ball.

While conventional golf tees provide satisfactory support functions for a golf ball, these tees have many drawbacks. First, in order for the tee to support the ball, the tapered end of the tee must be driven into the playing surface. This may be difficult, however, when the playing surface is very hard. This situation may arise, for example, when the ground is rocky or firm, or is frozen. Alternatively, this may happen when the player is practicing at an indoor area or at a driving range where the tee area is concrete, carpet, or other solid impermeable material.

Second, conventional tees require a large amount of wood or plastic, and, when made of wood, are often broken and require frequent replacement. Further, such tees have no utility other than to support a golf ball.

While efforts have been made to place advertisements or messages on conventional tees, limitations render imprinting the tee relatively useless. Because of the size and shape of the conventional tee, however, it is difficult to print anything on the tee, and it is not possible to put a large quantity of printed material onto the tee. Further, because of the overall shape of these tees, they are not suited to being distributed and used as advertisements or business cards.

Several alternatives to the conventional tee have been fashioned for teeing up a golf ball. Many of these tees are constructed from a flat sheet of paper or another similar material folded into a complex support structure. For example, U.S. Pat. No. 1,674,814 to Anderson discloses a golf tee comprising a flat sheet of cardboard having two sides which can be interconnected to provide a golf ball support structure.

Some of these tees have the advantage that they are more suitable for displaying printing or other materials thereon. Unfortunately, these alternative tees all suffer from the fact that when in their flat state (if such a state is possible) the shape of the device is not business card-like, or the device is not entirely suitable for printing material thereon. For example, when such tees are in their "flat" state, there are often many creases and/or holes in the device, rendering it difficult to place printing thereon. Further, some of these devices have exhibited some suitability for use as an advertisement, but have not been well suited to supporting a golf ball when configured into a tee.

There remains a need therefore, for a device which can be used as a business card or other advertising device, and which can also act as a suitable golf tee. Such a device should easily be transformable from a business card into a golf tee and vice versa, and when in golf tee form, provide adequate support for a golf ball.

SUMMARY OF THE INVENTION

In order to overcome the above stated problems and limitations, there is provided the present invention: a device which can be transformed from the form of a golf tee to the form of a business card, and vice versa.

The device of the present invention preferably comprises, in one form, a substantially flat card preferably having the size of a standard business card, the card having opposing first and second edges with first and second side portions located there between. This card may have any variety of printing located on it for providing advertising or identification functions.

An interengaging means is provided for connecting the first and second side portions of the card, so as to force the card into an arched shape. In the preferred form, the interengaging means comprises a tab and a slot combination. The tab is located within the card and is partially separable from the card. The tab comprises a stem, body, neck, and a number of keys. A first end of the stem is connected to the card at the first side portion thereof. The body is a primarily elliptical member connected to a second end of the stem. The keys extend on either side of the neck, which extends from the side of the body opposite the stem.

A slot is located in the second side portion of the card. The slot is designed to accept the keys of the tab, and to lock the tab in place.

Because the tab is only partially separable from the card, the tab normally comprises a solid portion of the card, thus not interrupting printing thereon. Further, the slot is of a size that it does not interfere with the placement of printing on the card, or the viewing thereof.

In a second form, the device of the present invention comprises a golf tee. The golf tee is created by engaging the interengaging means. In the preferred form, this comprises dislodging the tab from the card and passing one or more of the keys of the tab through the slot in the card until they are locked in place. At this time, the tab acts as a bridge between the first and second side portions of the card, which forms an arched shape as the first and second side portions are pulled together. In this manner, the first and second side portions of the card become first and second support legs for the tee, with the first and second edges of the card contacting the playing surface.

Removal of the tab portion of the card when forming the tee results in a void in the card at the former location of the body of the tab. When the card is in arched form, this void is situated at the top of the card between the first and second side portions (in tee form, the first and second legs), forming a saddle into which a golf ball may be placed.

In the preferred embodiment, height adjusting means for adjusting the height of the ball-supporting portion of the tee above the ground is provided. In one form, the height adjusting means comprises, as described above, a number of keys on the tab for engagement with a single slot. This arrangement allows the distance between the first and second side portions of the card to be adjusted, whereby the total height of the card in arcuate form is also adjusted. In an alternate embodiment, the height adjusting means comprises a single key for engagement with one or more slots.

The present invention has the advantage that it permits printing or other material to be placed on it, and when in its card form performs as a normal business card. The present invention, however, is also easily transformable into a golf tee. The resultant golf tee is flexible, yet provides adequate support for a golf ball.

The golf tee of the present invention has the advantage that it has an elongate shape which allows the user to properly sight and align the ball teed with the hole. The tee has flexibility in the direction of the golf club movement, minimizing breakage of the device. Further, the tee of the present invention is useful on all types of surfaces, as it need not be pressed into the playing surface to be useable. Lastly, the tee is easily to locate after the ball has been hit.

Further objects, features, and advantages of the present invention will become apparent from the detailed description of the drawings which follows, when considered with the attached figures.

DETAILED DESCRIPTION OF THE PREFERRED EMBODIMENT

Figure 1:
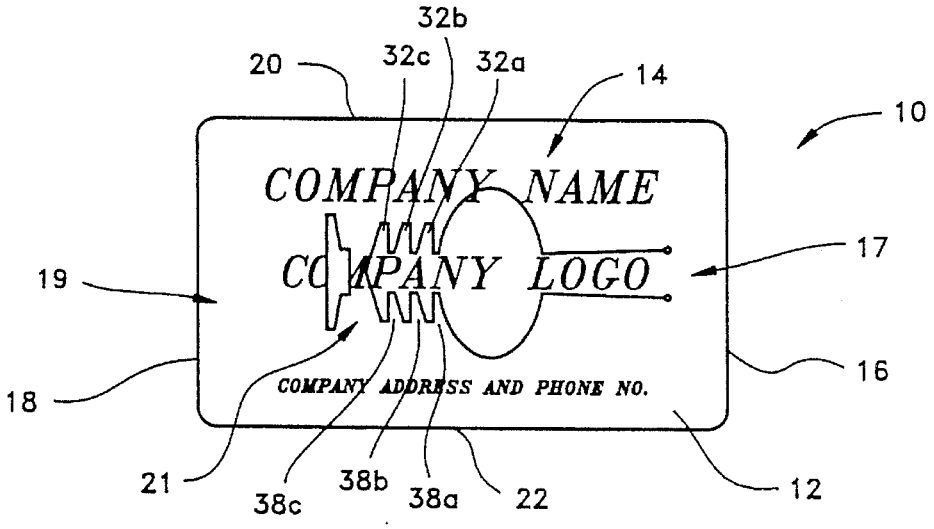
FIG. 1 is a top view of a golf tee device of the present invention, illustrating the device as used as a business card.

FIG. 1 illustrates a golf ball tee device 10 of the present invention. In a preferred form, and as illustrated in FIG. 1, the device 10 may be used as a promotional device or business card 12. In this form, the device 10 comprises a substantially flat piece of rectangular material on which printing 14 or other advertisements may be located. The card 12 preferably has a first edge 16 and opposing second edge 18, and a third edge 20 and opposing fourth edge 22. While the preferred form of the device 10 is a rectangle with parallel opposing edges 16, 18 and 20, 22, it is, of course, possible for the edges to not be parallel. Further, while it is preferred that the edges 16, 18, 20, 22 be straight, it is possible for the edges to take on other forms. For example, one or more of the edges could be somewhat arcuate, or include one or more ground engaging projecting areas, or be shaped such that the card 12 takes on a tapered form in one or more areas. The card 12 also includes a first side portion 17 and a second side portion 19 located between said first and second edges 16, 18.

Preferably, the card 12 has dimensions of about ½" to 3" from third edge 20 to fourth edge 22, and 2" to 4" from first edge 16 to second edge 18. Most preferably, the card 12 has dimensions of a standard business card, i.e. about 2" from third edge 20 to fourth edge 22, and about 3.5" from first edge 16 to second edge 18. Of course, the card 12 can have any of a variety of dimensions.

The card 12 is preferably made of plastic and/or rubber, or a similar flexible, tear-resistant, waterproof material. One material which is believed to be suitable is Lexan (TM). The card 12 could comprise a paper card which has been laminated with a plastic material, or could be made from numerous other materials such as aluminum or the like. The card 12 is most preferably about 15 mm in thickness and made from a plastic/rubber combination. Further, the card 12 may be of a translucent material having colored printing 14 thereon, or be made of a colored plastic or other material with varied colored printing 14 thereon.

Figure 4:
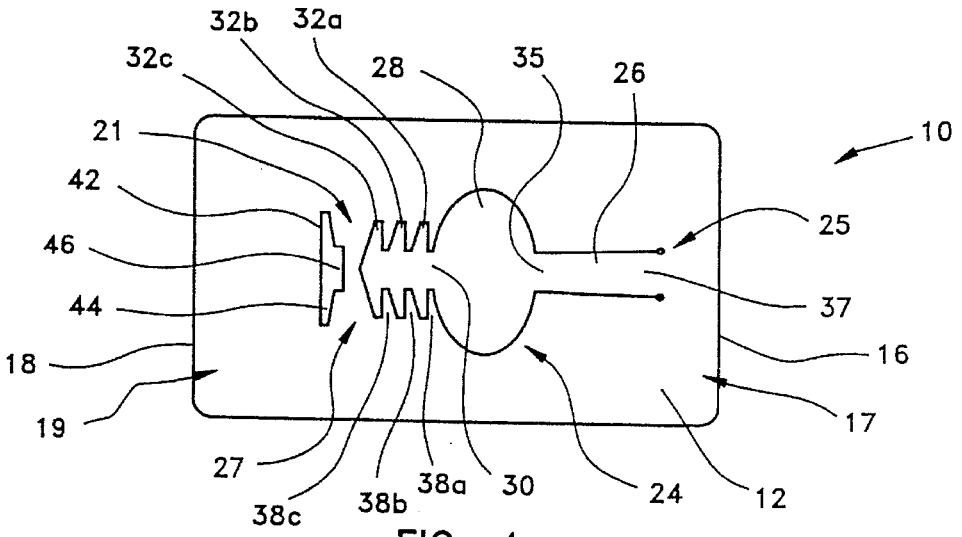
FIG. 4 is a top view of the business card/golf tee of FIG. 1, illustrated without printing thereon.

Preferably, and as more clearly illustrated in FIG. 4, the card 12 includes an interengaging fastening means 21. In the preferred form, the interengaging fastening means 21 comprises a selectively moveable tab 24 for engagement in a slot 42. The tab 24 is preferably a section of the card 12 material which is partially separable from the remaining portion of the card 12, but which remains at least partially attached thereto. As illustrated in FIG. 4, the tab 24 has a first end 25 and a second end 27, and preferably comprises an elongated stem 26 extending from the first end 25 of the tab 24, a body 28, a neck 30, and at least one key 32.

It is preferred that the tab 24 be created by cutting or stamping material from the card 12, although any means known to one skilled in the art may be used. For example, the card 12 and tab 24 may even be created during a molding process.

As illustrated, the stem 26 is an elongate, narrow strip or leg member, having a first end 37 (corresponding to the first end 25 of the tab 24) attached to card 12 at the first side portion 17 of the card. The exact location of attachment may vary, although it is preferred that the first end 37 of the stem 26 be located some distance inwardly on the card 12 from the first edge 16 of the card, so that the tab 24 can not be easily separated from the card 12 by tearing of the card material.

The body 28 of the tab 24 is a preferably ovoid or elliptically shaped member which is connected to a second end 35 of the stem 26. The body 28 is most preferably oval, and has a dimension in a direction parallel to the third and fourth edges 20, 22 of the card 12 of about 1.5 cm, and a dimension in a direction parallel to the first and second edges 16, 18 of the card 12 of about 2.5 cm. As will be described in more detail below, the body 28 may have any shape such that upon its removal from the card 12, the resulting card perimeter will provide support for a golf ball. Therefore, it is possible for the body 28 to be triangular, circular, square, or any combination thereof, in shape.

Of course, the body 28 can have any of a variety of shapes, as long as removal of the body 28 portion of the tab 24 creates a void in the card 12 which is useful in placement of a golf ball therein, as described in more detail below. Further, the body 28 can have any size as long as the resultant void upon its removal from the card 12 is not great enough to allow passage of a golf ball through when the device 10 is used as a golf tee.

The neck 30 extends from the body 28 of the tab 24 on the side of the body 28 opposite the stem 26. The neck 30 is a narrow member on which the keys 32 *a,b,c* are located.

Each key 32 *a,b,c* is preferably a somewhat elongate body extending in either direction parallel to a line connecting the top edge 20 and bottom edge 22 of the card 12. As seen in FIG. 4, each key 32 is preferably about 0.5 cm-2.5 cm, and most preferably about 1.5 cm, in length from end to end, and about 1–10 mm in width. The keys 32 *a,b,c* are spaced apart and located along the narrow neck 30, creating small recesses 38 therebetween. In the preferred embodiment, there are three key members 32*a,b,c*, although there may be as few as one, or as many as five or more. As can be seen, when there are three key members 32, there are preferably three recesses 38*a,b,c*. As illustrated, the separation between each key 32 is about 1–2 mm.

The slot 42 is located in the card 12 in the second side portion 19 of the card 12, and preferably somewhat adjacent the second end 27 of the tab 24. This slot 42 preferably comprises a void of material in the card 12, which void may be created by stamping or cutting away the card material. The slot 42 could also be molded directly into the card 12. It is alteratively possible that the slot 42 comprise a flap of material which, although not fully disconnected from the card, can be selectively opened or separated from the card.

As illustrated, the slot 42 comprises a thin, wide opening 44, and a narrow tab engaging portion 46. The wide opening 44 of the slot 42 is dimensioned to allow one or more of the keys 32 *a,b,c* on the tab 24 to be passed therethrough. Therefore, the opening 44 has a width of at least as great as the length of each key 32.

On the other hand, the engaging portion 46 of the slot 42 is somewhat narrow as compared to the opening 44. The engaging portion 46 is sized to prevent passage of a key 32 *a,b,c* therethrough, but is large enough to accept the neck 30 as exposed in the recesses 38 between sets of keys 32 *a,b,c*.

Figure 2:
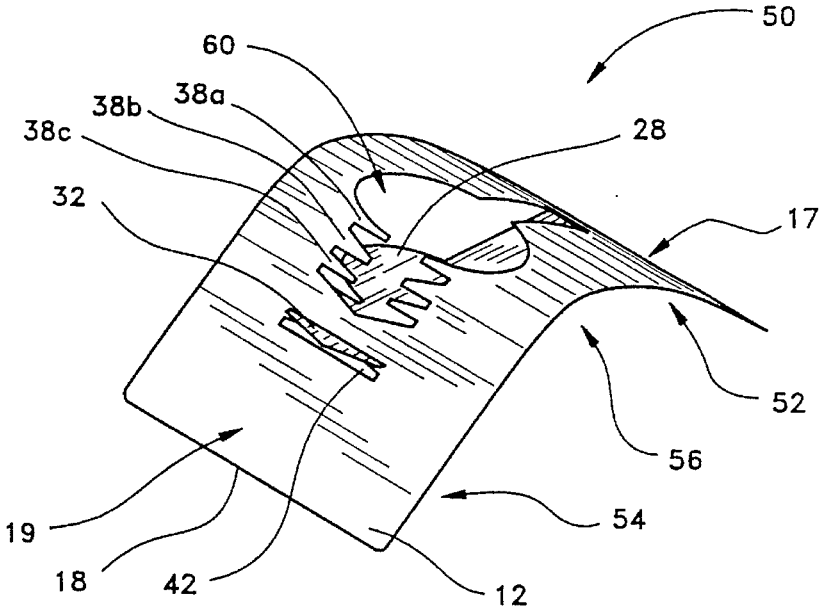
FIG. 2 is an isometric view of the device of FIG. 1, illustrating the device used as a golf tee.
Figure 3:
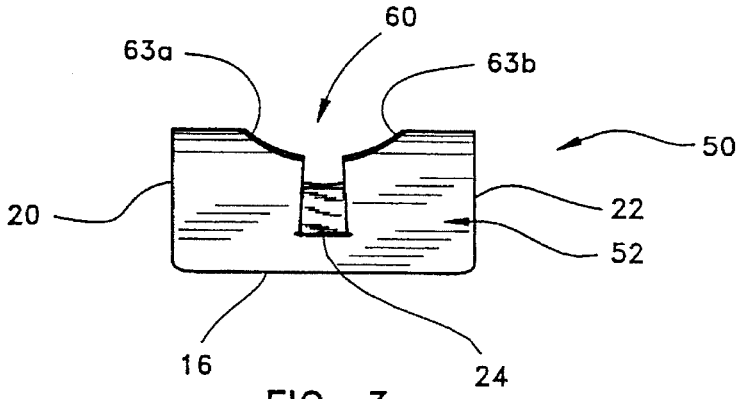
FIG. 3 is an end view of the device as used as a golf tee as illustrated in FIG. 2.

Most advantageously, the device 10 of the present invention can be converted from a business card 12, to a golf ball tee 50, as illustrated in FIGS. 2 & 3. As can be seen, the golf ball tee 50, comprises the card 12 presented in an arched fashion. The tee 50 is created by engaging the interengaging fastening means 21 on the card 12. When utilizing the preferred form of the invention, as described above, this entails passing one or more of the keys 32 *a,b,c* on the tab 24 through the slot 42, and selectively locking the tab 24 in place by engaging one of the recessed areas 38 *a,b,c* within the engaging portion 46 of the slot 42.

In this manner, the tab 24 acts as a bridge or leg member between the first side portion 17 and second side portion 19 of the card, acting to pull these two portions of the card towards one another. In this fashion, the first side portion 17 of the card 12 acts as a first supporting leg 52 for the tee 50, and the second side portion 19 of the card acts as a second supporting leg 54 for the tee. It is noted that the keys 32 and slot 42 are merely the preferred structure for securing the second end 27 of tab 24 to the card 12. Numerous other connecting arrangements can be used, as are known to one skilled in the art.

When placed in ball-supporting position on the ground 51 or other playing surface, the tee 50 assumes an arched or inverted U-shape, with the opposing first and second edges 16, 18 of the card 12 in contact with the ground. It is noted that it is possible to even provide creases in the card 12 (although this is not desireable from the standpoint that it interferes with the printing of the card 12), which creases could allow the card 12 to form an inverted-V or similar shape when formed into a tee.

Figure 5:
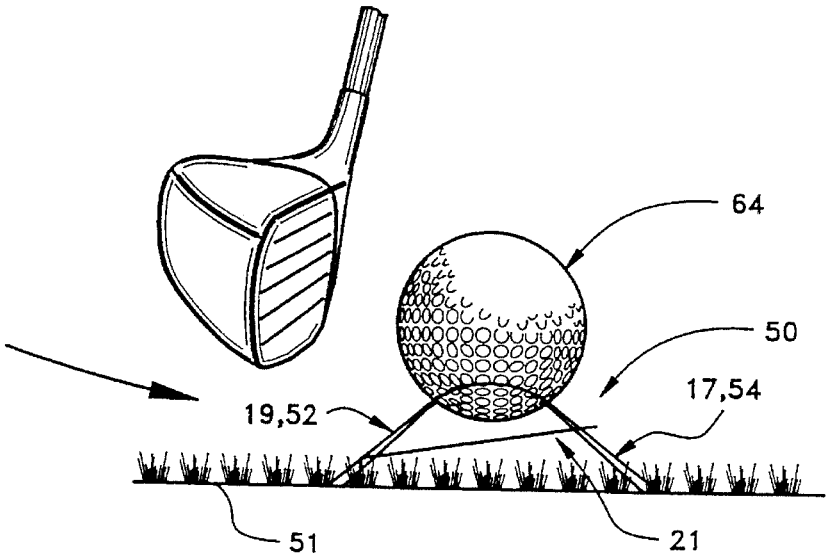
FIG. 5 is a side view of the device of the golf tee of FIG. 2, as used to support a golf ball above a playing surface for hitting by a golf club.

Located in the center of the card 12, and now at the top of an arch 56 thereof, is a saddle 60 created by the displacement of the body 28 of the tab 24 from the card 12. The saddle 60 creates an area in which a golf ball 64 may be placed, as illustrated in FIG. 5. This saddle 60 is comprised, in part, by two arcuate surfaces 63*a,b* which formerly defined the boundary of the body 28 of tab 24.

When using the tee 50, it is preferred that the user strike the ball 64 in a direction such that the club moves along the length of the tee 50 from the first leg 52 towards the second leg 54, as illustrated in FIG. 5. In this manner, the tee 50 is allowed to flex as the ball 64 is being hit. As can be seen, when the club is moved across the tee 50, the tee 50 can flex and move in the direction of the club and ball 64, reducing the possibility that the tee 50 will be broken.

After the user is through using the device 10 as a golf tee 50, the interengaging means 21 can be disengaged (in this case by disconnecting tab 24 from the slot 42) to allow the device 10 to return to the card 12 form.

Advantageously, the numerous keys 32 on the tab 24 in combination with the single slot 42 provides a height adjustment means. The height adjustment means allows the total height of the tee 50 above the ground 51 or other playing surface to be adjusted. In particular, by passing more of the keys 32 through the slot 42 in the card 12, and engaging a recess 38 closer to the body 28 of the tab 24, the first side portion 17 and second side portion 19 of the card 12 are brought closer together. In this manner, the height of the tee 50 is increased.

The device 10 of the present invention has the advantage that it provides substantial support for the golf ball 64 placed therein. In particular, the width of the legs 52, 54 which support the tee 50 provides a stable support which tends to prevent the tee 50 from falling over. Further, the present design presents an improvement over the conventional tee, as it does not need to be inserted into the ground to provide a support function.

The tee 50 of the present invention also has the advantage of aiding the user in lining up the ball with the hole. In particular, a user can sight along the length of the tee 50 from the first leg 52 to the second leg 54, and line up the ball and swing, so as to direct the ball properly to the hole, as illustrated in FIG. 5.

Figure 6:
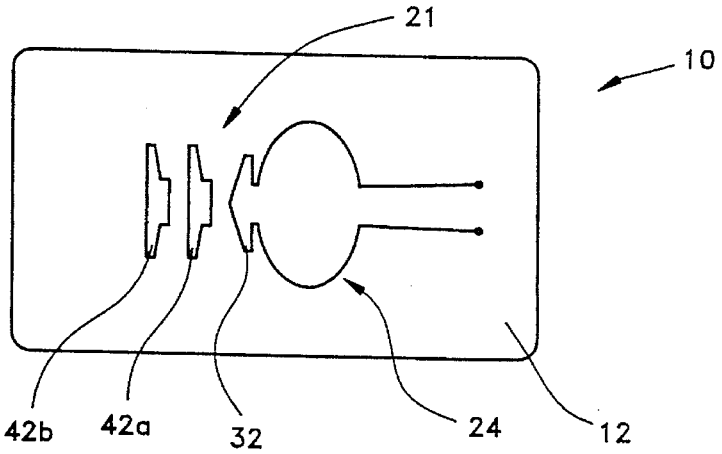
FIG. 6 is a top view of an alternate embodiment business card/golf tee of the present invention.

In a second embodiment of the present invention, as illustrated in FIG. 6, the interengaging means 21 again comprises a tab 24 and at least one slot 42. However, in this embodiment, the height adjusting means comprises one key 32 in combination with numerous slots 42*a,b*. In this fashion, the card 12 can still be formed into a tee 50, although the adjustment of the height of the tee 50 is accomplished by moving the single key 32 into each of the different slots 42*a,b*.

It will be understood that the above described arrangements of apparatus and the method therefrom are merely illustrative of applications of the principles of this invention and many other embodiments and modifications may be made without departing from the spirit and scope of the invention as defined in the claims.

We claim:

1. A golf tee comprising:

a resilient, flexible sheet member movable between a first generally flat, planar position and a second non-planar ball-supporting position for retaining a golf ball elevated above a playing surface;

said sheet having first and second opposing edges and third and fourth opposing edges, said first, second, third, and fourth opposing edges forming a contiguous rectangular perimeter, said first and second edges forming ground-contacting support surfaces for said member when said member is in said ball-supporting position, first and second side portions positioned between the opposing first and second edges, a central ball-supporting portion located between the side portions, and interengaging fastening means for releasably connecting the first and second side portions to retain the sheet member in the ball-supporting position.

2. The golf tee of claim 1, wherein said central ball-supporting portion is oval in shape.

3. The golf tee of claim 1, wherein said central ball-supporting portion is elliptical in shape.

4. The golf tee of claim 1, wherein said sheet forms an arch when said interengaging means are engaged.

5. The golf tee of claim 1, wherein said first and second side portions of said sheet form first and second supporting legs of said tee when said sheet is in the second non-planar form.

6. A golf tee comprising:

a resilient, flexible sheet member movable between a first generally flat, planar position and a second non-planar ball-supporting position for retaining a golf ball elevated above a playing surface;

said sheet having first and second opposing edges, said edges forming ground-contacting support surfaces for said member when said member is in said ball-supporting position, first and second side portions positioned between the opposing edges, a central ball-supporting portion located between the side portions, and interengaging fastening means for releasably connecting the first and second side portions to retain the sheet member in the ball-supporting position, wherein said interengaging means comprises a tab having at least one key thereon and a first end connected to said sheet, and at least one slot located in said sheet, said tab spanning a gap between said first and second side portions when said sheet is in said ball-supporting position.

7. The golf tee of claim 6, wherein said tab has three keys thereon.

8. A golf tee comprising:

a resilient, flexible sheet member movable between a first generally flat, planar position and a second non-planar ball-supporting position for retaining a golf ball elevated above a playing surface;

said sheet having first and second opposing edges, said edges forming ground-contacting support surfaces for said member when said member is in said ball-supporting position, first and second side portions positioned between the opposing edges, a central ball-supporting portion located between the side portions, interengaging fastening means for releasably connecting the first and second side portions to retain the sheet member in the ball-supporting position, and wherein said sheet member includes height adjusting means.

9. The golf tee of claim 8, wherein said height adjusting means comprises more than one key located on a tab which spans a gap between said first and second side portions when said sheet is in said ball-supporting position and engages at least one slot in said sheet.

10. The golf tee of claim 8, wherein said height adjusting means comprises a key located on a tab which spans a gap between said first and second side portions when said sheet is in said ball-supporting position and engages at least one slot in said sheet.

11. A device for use as a business card or a tee for holding a golf ball, comprising:

a card having opposing parallel first and second edges and opposing parallel third and fourth edges and a centerline extending between said third and fourth edges and parallel thereto, and a first side portion and a second side portion located on said centerline, said first side portion located adjacent said first edge and said second side portion located adjacent said second edge; and means for connecting said first and second side portions so that said card forms an arcuate member, with said first and second side portions acting as first and second legs of a golf tee and said first and second edges acting as ground-contacting support surfaces for said legs.

12. The device of claim 11, wherein said means comprises a tab having a first end connected to said card and a second end including means for engaging a slot in said card at said second end.

13. The device of claim 12, wherein said tab normally comprises a portion of said card.

14. The device of claim 11, wherein said card is rectangular in shape.

15. A device for use as a business card or a tee for holding a golf ball, comprising:

a card having opposing first and second edges, and a first side portion and a second side portion located between said edges; and means for connecting said first and second side portions so that said card forms an arcuate member, with said first and second side portions acting as first and second legs of a golf tee and said first and second edges acting as ground-contacting support surfaces for said legs, wherein said means for connecting comprises a tab having a first end connected to said card and a second end including means for engaging a slot in said card at said second end and wherein a number of keys and recesses are located on said second end of said tab.

16. A device for use as a business card or a tee for holding a golf ball, comprising:

a card having opposing first and second edges, and a first side portion and a second side portion located between said edges; and means for connecting said first and second side portions so that said card forms an arcuate member, with said first and second side portions acting as first and second legs of a golf tee and said first and second edges acting as ground-contacting support surfaces for said legs and wherein said means for connecting includes means for creating a void in said card into which a golf ball may be placed.

17. A device for use as a business card or a tee for holding a golf ball, comprising:

a card having opposing first and second edges, and a first side portion and a second side portion located between said edges; and means for connecting said first and second side portions so that said card forms an arcuate member, with said first and second side portions acting as first and second legs of a golf tee and said first and second edges acting as ground-contacting support surfaces for said leg and wherein said means for connecting comprises a portion of said card in the form of a tab, said tab having a first end connected to said card and a second end including means for engaging a slot in said card, said tab moveable between a first position in which it forms a contiguous portion of said card, and a second position in which said tab spans said card from said first side portion to said second side portion and retains said card in an arcuate position.

18. The device of claim 17, wherein said tab includes an elliptical-shaped central portion wherein when said tab is moved to said second position, an elliptical-shaped ball holding void is created in said card.

19. A device for use as a business card or a tee for holding a golf ball, comprising:

a card having opposing first and second edges, and a first side portion and a second side portion located between said edges; and means for connecting said first and second side portions so that said card forms an arcuate member, with said first and second side portions acting as first and second legs of a golf tee, said means for connecting including means for creating a void in said card into which a golf ball may be placed.

20. The device of claim 19, wherein said means comprises a tab.

21. The device of claim 20, wherein said tab has at least one key thereon for engagement with at least one slot located in said card.

22. The device of claim 19, wherein said means for connecting creates a saddle-shaped void into which a golf ball may be placed.

* * * * *